US005939867A

United States Patent [19]

Capici et al.

[11] Patent Number: 5,939,867

[45] Date of Patent: Aug. 17, 1999

[54] LOW CONSUMPTION LINEAR VOLTAGE REGULATOR WITH HIGH SUPPLY LINE REJECTION

[75] Inventors: Salvatore Vincenzo Capici, Barrafranca; Patrizia Milazzo, Messina; Francesco Pulvirenti, Acireale, all of Italy

[73] Assignee: STMicroelectronics S.r.l., Agrate Brianza, Italy

[21] Appl. No.: 09/141,251

[22] Filed: Aug. 27, 1998

[30] Foreign Application Priority Data

Aug. 29, 1997 [EP] European Pat. Off. ..... 97830434

[51] Int. Cl.[6] ..... G05F 1/565

[52] U.S. Cl. ..... 323/277; 323/280

[58] Field of Search ..... 323/280, 268, 323/273, 277, 282, 312, 316

[56] References Cited

U.S. PATENT DOCUMENTS

| | | | |
|---|---|---|---|
| 4,315,207 | 2/1982 | Apfel | 323/284 |
| 4,560,918 | 12/1985 | Callen | 323/273 |
| 4,585,987 | 4/1986 | Prue, Jr. et al. | 323/275 |
| 4,667,145 | 5/1987 | Moreau | 323/275 |
| 4,899,098 | 2/1990 | Gariboldi | 323/277 |
| 4,906,913 | 3/1990 | Stanojevic | 323/303 |
| 5,191,278 | 3/1993 | Carpenter | 323/275 |
| 5,325,258 | 6/1994 | Choi et al. | 361/87 |
| 5,548,205 | 8/1996 | Monticelli | 323/274 |
| 5,559,423 | 9/1996 | Harman | 323/277 |
| 5,592,072 | 1/1997 | Brown | 323/268 |
| 5,783,934 | 7/1998 | Tran | 323/312 |
| 5,804,956 | 9/1998 | Pulvirenti | 323/277 |

FOREIGN PATENT DOCUMENTS

0476365 A1 9/1990 European Pat. Off. .

*Primary Examiner*—Adolf Deneke Berhane

*Attorney, Agent, or Firm*—Allen, Dyer, Doppelt, Milbrath & Gilchrist, P.A.

[57] ABSTRACT

A linear type of voltage regulator, having an input terminal adapted to receive a supply voltage thereon, and an output terminal adapted to deliver a regulated output voltage, includes a power transistor and a driving circuit therefor. The driving circuit includes an operational amplifier having a differential input stage biased by a bias current which varies proportionally with the output current of the regulator.

23 Claims, 4 Drawing Sheets

LOW CONSUMPTION LINEAR VOLTAGE REGULATOR WITH HIGH SUPPLY LINE REJECTION

FIELD OF THE INVENTION

This invention relates to electronic circuits, and, more particularly to a linear voltage regulator.

BACKGROUND OF THE INVENTION

A linear voltage regulator may typically be used with portable battery-powered devices, e.g. cellular telephones. Typical requirements for such regulators are a high PSRR (Power Source Rejection Ratio), very fast response to load transients, low voltage drop, and above all low current consumption, so that the battery charge may last longer.

Such a linear regulator is currently typically implemented with an N-channel MOS power transistor. The adoption of an N-channel transistor is prompted since, for the same performance level, it allows optimum utilization of the silicon area. It also permits a reduction of at least one order of magnitude in the value of the output capacitor.

An exemplary application of a voltage regulator according to the prior art is shown in FIG. 1. A low-drop type of regulator with an N-channel topology, as is shown in FIG. 1, requires that a driving circuit OP be supplied a higher voltage VCP than the power supply voltage VBAT which can be delivered. This higher voltage, in the state-of-art, is provided by a charge pump circuit 2.

The operation of the circuit of FIG. 1 will now be described in detail. The current consumption of the regulator can be calculated by adding together the current $I_{res}$ flowing through the divider R1–R2 and the current $I_{op}$ drawn by the driving circuit OP for the power transistor M1. Since the charge pump circuit 2 used for powering the driving circuit OP is a by-n multiplier of the input voltage VBAT, its current draw on the battery will be n times the current $I_{op}$ that it supplies to the driving circuit OP.

When the efficiency $E_{FF}$ Of the charge pump circuit is also taken into account, the overall current draw of the regulator on the battery is given as:

$$I_{REG}=(n/E_{FF})*I_{OP}+I_{res}.$$

The compensation employed with a regulator with this topology usually is of the pole-zero type, wherein the internal zero is to cancel out the pole introduced by the load capacitor. The outcome of such compensation is that a dominant pole is created, which greatly slows down the response to load transients and undermines performance in terms of power source rejection.

A known approach to address this problem includes increasing the bias current $I_{op}$ of the differential stage in the driving circuit OP with a consequent increase in the regulator overall consumption. However, this prior approach clashes with the basic requirement for battery-powered devices having the lowest possible current consumption.

SUMMARY OF THE INVENTION

An object of the present invention is to provide a linear type of voltage regulator having its current consumption optimized and controlled, with improved PSRR and faster response to load transients.

This and other objects in accordance with the present invention are provided by a linear voltage regulator comprising: an input terminal adapted to receive a supply voltage thereon, an output terminal adapted to deliver a regulated output voltage, and a power transistor having a control terminal and having a main conduction path connected in a path between the input terminal and the output terminal. The linear voltage regulator also includes an output current sensor for sensing an output current flowing along the path between the input terminal and the output terminal, and an operational amplifier having a differential input stage biased by a bias current. The operational amplifier also has a first input terminal connected to a voltage reference, a second input terminal coupled to the output terminal, and an output terminal coupled to the control terminal of the power transistor. Moreover, the linear regulator includes a bias current generator cooperating with the output current sensor for generating the bias current of the differential stage to vary proportionally with a value of the output current flowing in the path between the input terminal and the output terminal.

The output current sensor may comprise a sensing resistor connected in series with the main conduction path of the power transistor. In addition, the bias current generator may preferably comprise a transconductance operational amplifier having first and second inputs connected to first and second terminals, respectively, of the sensing resistor to measure a difference potential thereacross. The transconductance amplifier also preferably has an output terminal delivering an output current to bias the differential stage with the current that is proportional to the difference potential across the sensing resistor. In other words, the invention uses a driving circuit OP for the power transistor Ml which has an input differential stage biased by a bias current that varies proportionally with the output current of the regulator.

BRIEF DESCRIPTION OF THE DRAWINGS

The features and advantages of a circuit according to the invention will be more clearly apparent from the following detailed description of embodiments thereof, as illustrated by way of non-limitative examples in the accompanying drawings.

DETAILED DESCRIPTION OF THE PREFERRED EMBODIMENTS

Figure 2:
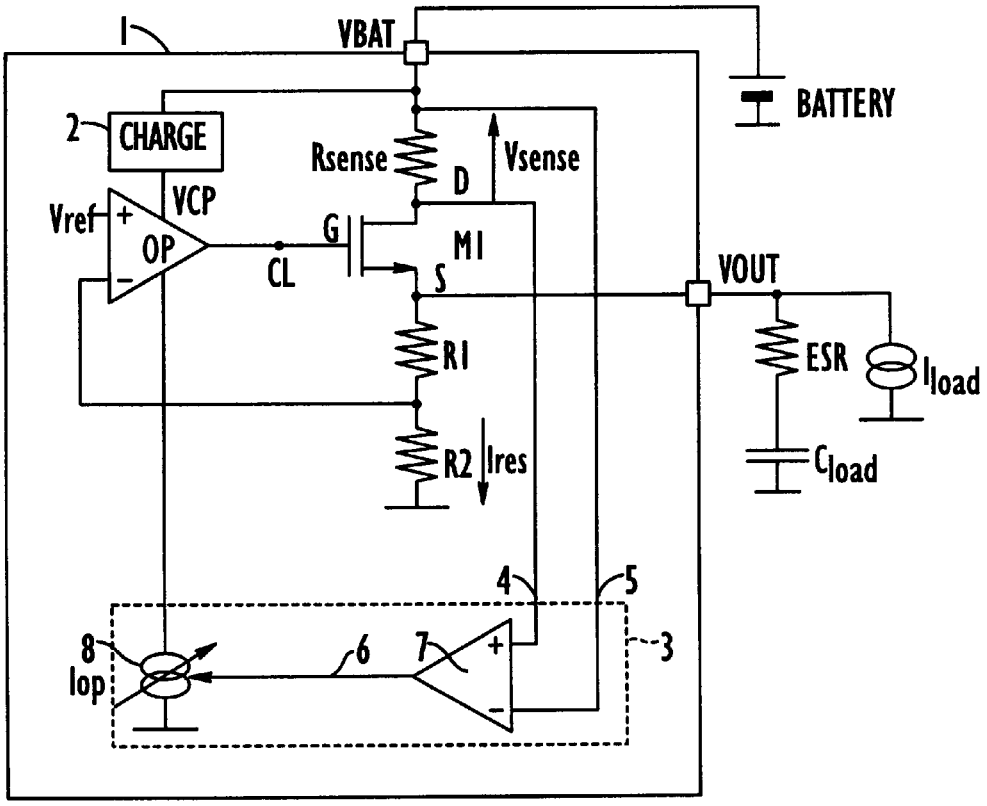
FIG. 2 shows a linear type of voltage regulating circuit according to this invention.

Shown at 1 in FIG. 2 is a linear type of voltage regulating circuit according to the invention. The regulating circuit 1 is connected between a battery (BATTERY), itself connected to a terminal VBAT of the circuit, and a load, itself connected to a terminal VOUT. This is illustrated schematically by an equivalent current generator $I_{load}$ in parallel with a load capacitor $C_{load}$ having an Equivalent Series Resistor (ESR).

The regulating circuit 1 includes a power transistor M1 of the N-channel MOS type having a drain-source main conduction path connected in series with a sensing resistor (Rsense) between the terminals VBAT and VOUT of the regulating circuit 1. The regulating circuit 1 also includes an operational amplifier OP, used as a driving circuit for the power transistor M1. The operational amplifier OP has a differential input stage biased by a given bias current $I_{op}$, a non-inverting input terminal connected to a voltage reference Vref, an inverting input terminal coupled to the output terminal VOUT of the circuit 1 through a resistive divider R1–R2, and an output terminal connected to the gating terminal G of the power transistor M1.

A charge pump circuit 2, is used for supplying a boosted voltage VCP to the operational amplifier OP. A transconductance operational amplifier 3 has a first input 4 and a second input 5 which are connected to first and second terminals, respectively, of the sensing resistor $R_{sense}$. The transconductance operational amplifier 3 comprises a differential input stage 7 controlling an output current generator 8 which supplies the bias current Iop to the differential input stage of the operational amplifier OP.

The operation of the circuit shown in FIG. 2 will now be described. As the load current $I_{load}$ increases from a minimum value to a maximum value, for example, the voltage drop $V_{sense}$ across the sensing resistor $R_{sense}$ also increases. The transconductance amplifier 3, having the voltage $V_{sense}$ applied to its inputs 4 and 5, generates a larger bias current $I_{OP}$. Thus, the bias current of the differential input stage of the amplifier OP, driving the power transistor M1, will be the larger, the larger is the load current $I_{LOAD}$, thereby improving the circuit speed of response. Accordingly, the current consumption of the regulator will only increase when the regulator is to supply large currents, or when abrupt variations, or transients, occur in the load current.

On the contrary, when the load current is zero or a very low value, or the current transient is over, the inputs 4 and 5 of the transconductance amplifier 3 are returned to the same potential, thereby restoring the current generator $I_{OP}$ to a very low quiescent current value.

Figure 3:
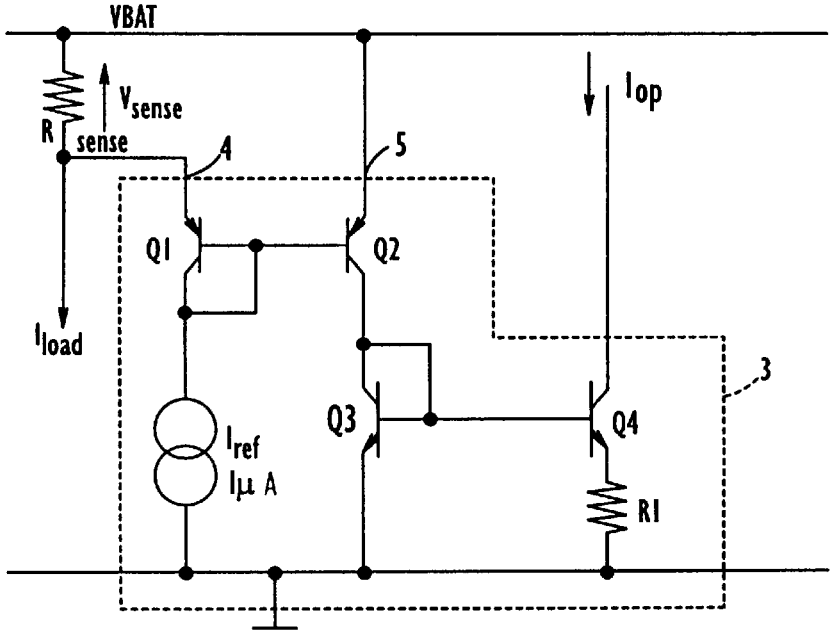
FIG. 3 shows a first embodiment of a portion of the voltage regulating circuit of FIG. 2.

The linear regulator as shown in FIG. 2 has been implemented with BCD (Bipolar-CMOS-DMOS) technology. Shown in FIG. 3 is a circuit diagram of a first embodiment of the transconductance operational amplifier 3 comprising bipolar transistors. The circuit 3 includes a differential input stage including transistors Q1 and Q2, a reference current generator $I_{ref}$, and an output current mirror Q3, Q4.

From the circuit of FIG. 3, it can be observed that the collector current of the transistor Q3 is given by:

$$I_{CQ3}=(I_{ref}/\mathrm{m})*\exp((R_{sense}*I\mathrm{load})/(EC*V_T))$$

where, m is the area ratio of transistors Q1 and Q2, and EC is the emission coefficient of transistors Q1 and Q2. Therefore, the bias current $I_{OP}$ will be given by the following implicit equation:

$$I_{Op}*R_1=V_T*\log((p*I_{CQ3})/I_{OP})$$

where, p is the area ratio of transistors Q3 and Q4.

The transistor Q4 will mirror, with an appropriate gain, the current of Q3 which is, in turn, dependent on the load current $I_{LOAD}$. Since this dependence is of an exponential type, a resistor R1 has been added to limit the maximum value that the current $I_{OP}$ is allowed to attain.

By suitably selecting the two area ratios m and p of the transistor pairs Q1–Q2 and Q3–Q4, it thus becomes possible to set, to low values, the bias current $I_{OP}$ under no load, thereby limiting the current draw on the battery. Then, by selecting suitable dimensions for the resistor R1, the maximum value can be set for the bias current $I_{OP}$ which provides, under full load, the desired PSRR (Power Source Rejection Ratio) and speed of response to transients.

Figure 1:
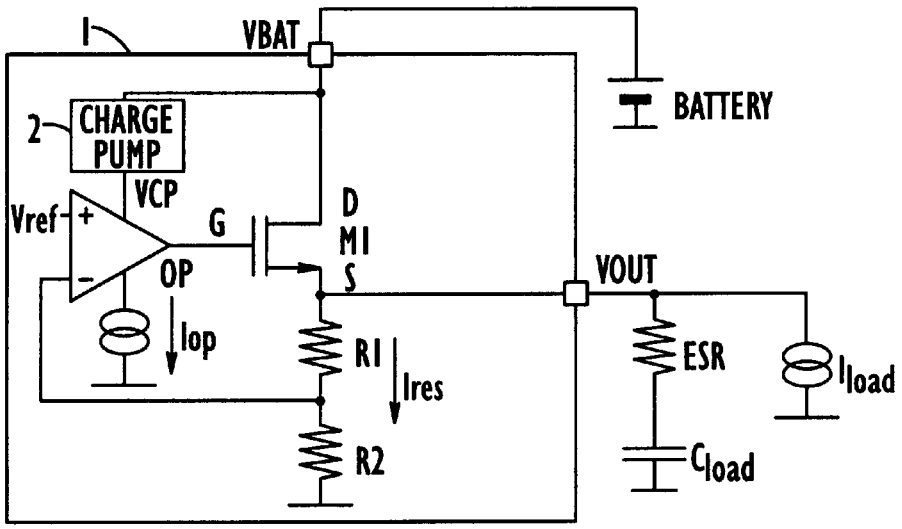
FIG. 1 PRIOR ART
FIG. 1 shows a linear type of voltage regulating circuit according to the prior art.
Figure 4:
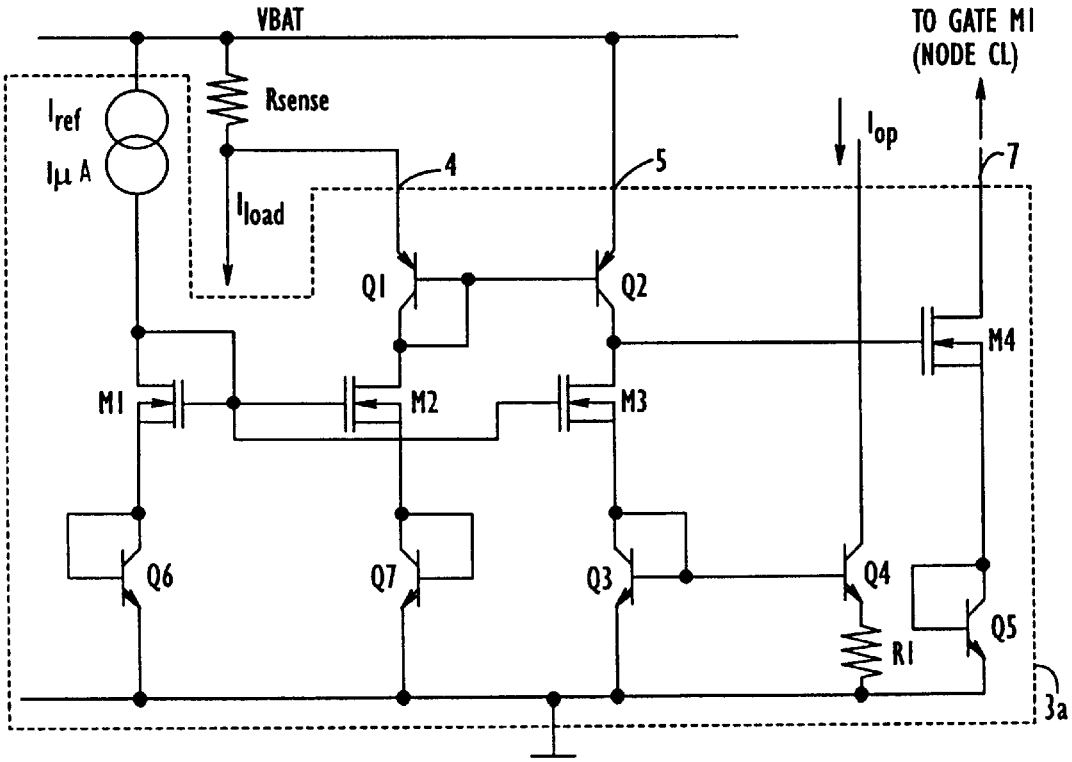
FIG. 4 shows a second embodiment of a portion of the voltage regulating circuit of FIG. 2.

On the other hand, where a conventional circuit such as shown in FIG. 1 is used, to obtain a similar performance in terms of PSRR and response to load transients, a constant bias current of a larger value would be necessary. This would entail a much higher overall consumption of the regulator at steady state.

Where a limitation is required on the maximum current from the regulator, the layout of the transconductance amplifier of FIG. 3 can be modified as illustrated by circuit 3*a* in FIG. 4. FIG. 4 shows a second embodiment of the transconductance operational amplifier 3 of FIG. 2, here denoted by the reference 3*a*.

For values of the load current $I_{LOAD}$ below the upper limit, the current flowing through the transistor Q2 is smaller than the current through the transistor Q1. Accordingly, the transistor M4 will be off and not affect the regulator operation. When the load current $I_{LOAD}$ exceeds a limiting value $I_{LIM}$ given by:

$$I_{LIM}=(V_T\cdot\log(m))/R_{sense},$$

m being the area ratio of transistors Q1 and Q2, the collector current of Q2 increases and turns on the transistor M4. Transistor M4, in turn, will drive, from the output terminal 7 the gate terminal of the power transistor M1 (node CL in FIG. 2), to deliver less current.

Figure 5:
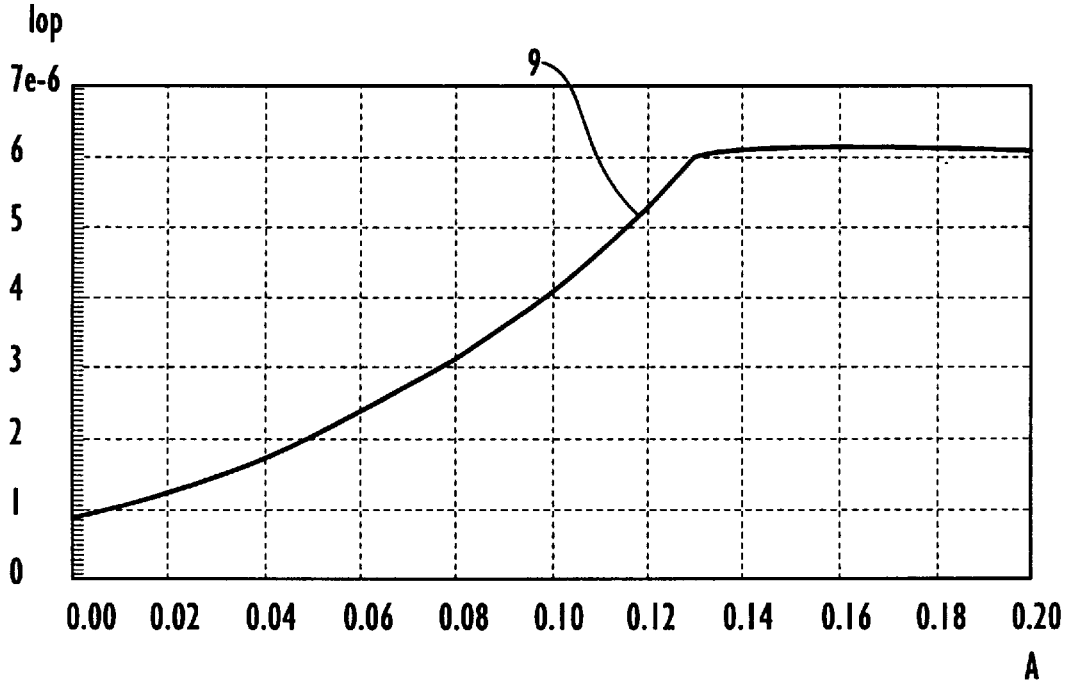
FIGS. 5, 6 and 7 are plots of some voltage and current signals as obtained by electrical simulation of the circuit of FIG. 2.

Plotted in FIG. 5 is the behavior of the bias current versus variations in the load current $I_{LOAD}$, as determined by electrical simulation. It can be seen that, in the no-load condition, the bias current $I_{Op}$ is approximately 870 nanoamperes, and rises to 4.18 microamperes under a load current of 100 milliamperes, corresponding to the maximum value specified for the load current. FIG. 5 also brings out the operation of the current limitation set at 140 milliamperes.

The no-load overall consumption of the regulator is 10 microamperes, and rises to 23 microamperes under a load current of 100 milliamperes. These values were obtained using a reference current $I_{ref}$ of 1 microampere and a divider R1–R2 (FIG. 2) dimensioned to provide a current $I_{res}$ of 4 microamperes.

Figure 6:
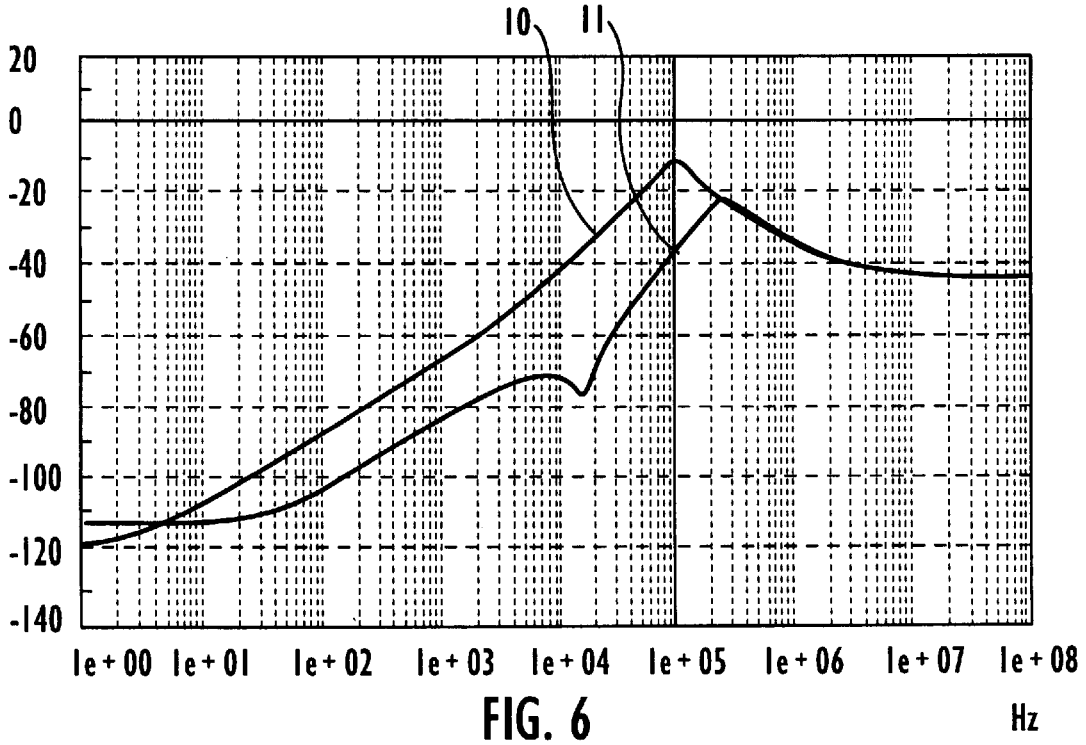

FIG. 6 shows the PSRR (Power Source Rejection Ratio) obtained with the circuit of FIG. 1 (curve 11) compared to that to be obtained by biasing the regulator with a fixed current of 870 nanoamperes (curve 10).

Figure 7A:
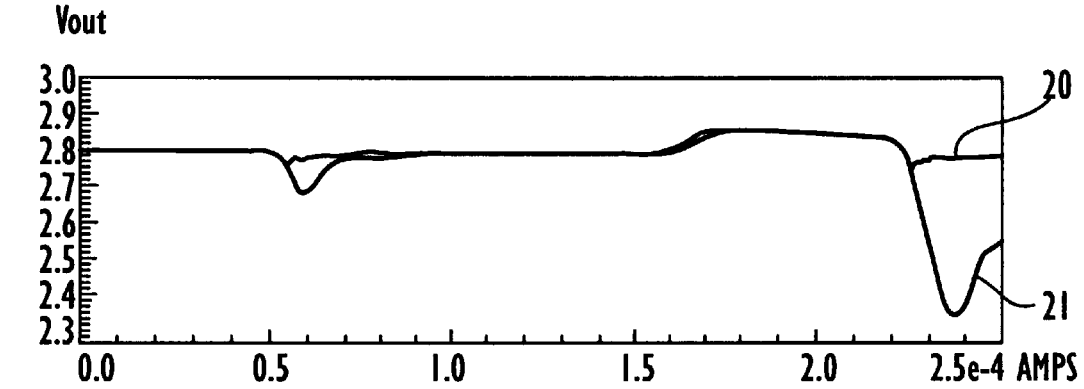
Figure 7B:
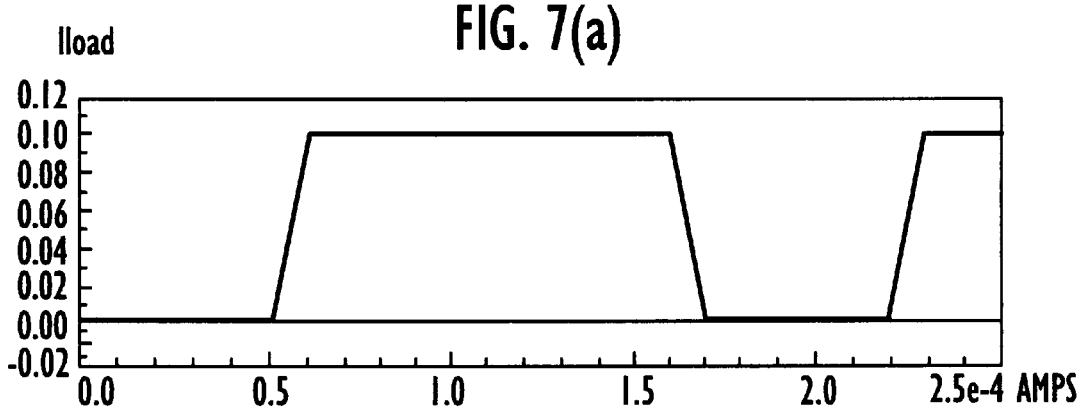

Plotted in FIG. 7 are patterns, as obtained by electrical simulation, of the output voltage $V_{OUT}$ (graph (a)) versus variations in the load current $I_{LOAD}$ (graph (b)). In graph (a), the plot of the signal $V_{OUT}$ obtained when using the proposed circuit (curve 20) is shown superposed on the plot of the same signal in a corresponding conventional circuit (curve 21). The smaller voltage drop of curve 20 upon abrupt variations in the load current $I_{LOAD}$ is apparent. It will be appreciated that this operation principle may also be used with regulators having different topologies.

In summary, the advantages of the present invention are: faster speed of response to transients of the differential stage of a linear regulator; low current consumption under no load or a very small load, and hence low average consumption of the regulator; and high power source rejection (PSRR).

That which is claimed is:

1. A linear voltage regulator comprising:

an input terminal adapted to recieve a supply voltage thereon;

an output terminal adapted to deliver a regulated output voltage;

a power transistor having a control terminal and having a main conduction path connected in a path between the input terminal and the output terminal;

an output current sensor for sensing an output current flowing along the path between the input terminal and the output terminal;

an operational amplifier having a differential input stage biased by a bias current, and having a first input terminal connected to a voltage reference, a second input terminal coupled to the output terminal, and an output terminal coupled to the control terminal of the power transistor; and a bias current generator cooperating with said output current sensor for generating the bias current of the differential stage to vary proportionally with a value of the output current flowing in the path between the input terminal and the output terminal.

2. A linear voltage regulator according to claim 1, wherein said output current sensor comprises a sensing resistor connected in series with the main conduction path of the power transistor.

3. A linear voltage regulator according to claim 2, wherein said bias current generator comprises a transconductance operational amplifier having first and second inputs connected to first and second terminals, respectively, of said sensing resistor to measure a difference potential thereacross, and having an output terminal delivering an output current which is proportional to the difference potential across said sensing resistor.

4. A linear voltage regulator according to claim 3, wherein the differential input stage of said operational amplifier is biased by output current from the transconductance amplifier.

5. A linear voltage regulator according to claim 1, wherein said power transistor is an N-channel MOS transistor.

6. A linear voltage regulator according to claim 1, further comprising a charge pump for supplying said operational amplifier a boosted voltage relative to the supply voltage.

7. A linear voltage regulator according to claim 1, further comprising a voltage divider coupled to the output terminal; and wherein a first input terminal of the operational amplifier is a non-inverting input terminal, and wherein a second input terminal is an inverting input terminal coupled to the output terminal through said voltage divider.

8. A linear voltage regulator comprising:

an input terminal adapted to receive a supply voltage thereon;

an output terminal adapted to deliver a regulated output voltage;

a power transistor having a control terminal and having a main conduction path connected in a path between the input terminal and the output terminal;

a sensing resistor connected in series with the main conduction path of the power transistor for sensing an output current flowing along the path between the input terminal and the output terminal;

an operational amplifier having a differential input stage biased by a bias current, and having a first input terminal connected to a voltage reference, a second input terminal coupled to the output terminal, and an output terminal coupled to the control terminal of the power transistor; and a transconductance operational amplifier having first and second inputs connected to first and second terminals, respectively, of said sensing resistor to measure a difference potential thereacross, and having an output terminal delivering an output current to bias the differential input stage of said operational amplifier based upon the difference potential.

9. A linear voltage regulator according to claim 8, wherein said transconductance amplifier biases the differential input stage proportional to current flow between the input terminal and the output terminal.

10. A linear voltage regulator according to claim 8, wherein said power transistor is an N-channel MOS transistor.

11. A linear voltage regulator according to claim 8, further comprising a charge pump for supplying said operational amplifier a boosted voltage relative to the supply voltage.

12. A linear voltage regulator according to claim 8, further comprising a voltage divider coupled to the output terminal; and wherein a first input terminal of the operational amplifier is a non-inverting input terminal, and wherein a second input terminal is an inverting input terminal coupled to the output terminal through said voltage divider.

13. A linear voltage regulator comprising:

a power transistor having a control terminal and defining a main conduction path;

an operational amplifier having a differential input stage biased by a bias current, and having a first input terminal connected to a voltage reference, and an output terminal coupled to the control terminal of the power transistor; and a bias current generator for generating the bias current of the differential stage to vary proportionally with a value of the output current flowing in the main conduction path.

14. A linear voltage regulator according to claim 13, wherein said bias current generator comprises a sensing resistor connected in series with the main conduction path of the power transistor.

15. A linear voltage regulator according to claim 14, wherein said bias current generator comprises a transconductance operational amplifier having first and second inputs connected to first and second terminals, respectively, of said sensing resistor to measure a difference potential thereacross, and having an output terminal delivering an output current which is proportional to the difference potential across said sensing resistor.

16. A linear voltage regulator according to claim 15, wherein the differential input stage of said operational amplifier is biased by output current from the transconductance amplifier.

17. A linear voltage regulator according to claim 13, wherein said power transistor is an N-channel MOS transistor.

18. A linear voltage regulator according to claim 13, further comprising a charge pump for supplying said operational amplifier a boosted voltage relative to the supply voltage.

19. A linear voltage regulator according to claim 13, further comprising a voltage divider coupled to an inverting input terminal of said operational amplifier.

20. A method for linear voltage regulation comprising the steps of:

providing a power transistor having a control terminal and defining a main conduction path;

providing an operational amplifier having a differential input stage biased by a bias current, and having a first input terminal connected to a voltage reference, and an output terminal coupled to the control terminal of the power transistor; and generating the bias current for the differential stage to vary proportionally with a value of the output current flowing in the main conduction path.

21. A method according to claim 20, wherein the step of generating the bias current comprises connecting a sensing resistor in series with the main conduction path of the power transistor.

22. A method according to claim 21, wherein the step of generating the bias current comprises connecting a transconductance operational amplifier having first and second inputs to first and second terminals, respectively, of the sensing resistor to measure a difference potential thereacross, and having an output terminal delivering an output current which is proportional to the difference potential across the sensing resistor.

23. A method according to claim 20, wherein the power transistor is an N-channel MOS transistor; and further comprising the step of supplying the operational amplifier a boosted voltage relative to the supply voltage.

* * * * *

UNITED STATES PATENT AND TRADEMARK OFFICE

CERTIFICATE OF CORRECTION

PATENT NO. : 5,939,867
APPLICATION NO. : 09/141251
DATED : August 17, 1999
INVENTOR(S) : Salvatore Vincenzo Capici, Patrizia Milazzo and Francesco Pulvirenti It is certified that error appears in the above-identified patent and that said Letters Patent is hereby corrected as shown below:

Column 4, line 64 Delete: “recieve”
Insert: --receive--

Signed and Sealed this

First Day of July, 2008

JON W. DUDAS
*Director of the United States Patent and Trademark Office*